US010058219B2

(12) United States Patent
Collins et al.

(10) Patent No.: US 10,058,219 B2
(45) Date of Patent: Aug. 28, 2018

(54) HORIZONTAL AND VERTICAL TOOTHBRUSH HOLDER SUITABLE FOR THE APPLICATION OF TOOTHPASTE

(71) Applicants: Diana M. Collins, Gilbert, AZ (US); Lee E. Collins, Gilbert, AZ (US)

(72) Inventors: Diana M. Collins, Gilbert, AZ (US); Lee E. Collins, Gilbert, AZ (US)

( * ) Notice: Subject to any disclaimer, the term of this patent is extended or adjusted under 35 U.S.C. 154(b) by 0 days.

(21) Appl. No.: 15/401,061

(22) Filed: Jan. 8, 2017

(65) Prior Publication Data

US 2017/0196408 A1 Jul. 13, 2017

Related U.S. Application Data

(60) Provisional application No. 62/276,054, filed on Jan. 7, 2016.

(51) Int. Cl.
*A47K 1/09* (2006.01)

(52) U.S. Cl.
CPC ..... *A47K 1/09* (2013.01)

(58) Field of Classification Search
CPC .... A47K 1/09; A46B 17/02; A46B 2200/1066
See application file for complete search history.

(56) References Cited

U.S. PATENT DOCUMENTS 1,864,874 A * 6/1932 Voight ..... A47K 1/09 206/362.3
2,099,906 A * 11/1937 Pierce ..... A47K 1/09 132/308
2,117,459 A * 5/1938 Stanton ..... A47K 1/09 131/256
2,177,504 A * 10/1939 Thompson ..... A47K 1/09 206/361
D171,001 S 12/1953 Mayer
5,573,019 A * 11/1996 Hempel ..... A47K 1/09 132/308
6,364,165 B2 4/2002 Sampson et al.
6,758,446 B2 7/2004 Bjornrud
7,581,638 B2 * 9/2009 Shaw ..... A46B 17/06 132/308
7,721,899 B2 * 5/2010 Lambert ..... A47K 1/09 211/119.009
9,364,076 B2 * 6/2016 Mauffette ..... A47G 29/08
9,629,506 B1 * 4/2017 Schwarz ..... A47K 1/09
2004/0050733 A1 * 3/2004 Page ..... B65D 35/34 206/362.2
2004/0055977 A1 * 3/2004 Ryan ..... A47K 1/09 211/65

(Continued)

*Primary Examiner* — Bradley Duckworth
(74) *Attorney, Agent, or Firm* — Mark V. Loen

(57) ABSTRACT

The embodied invention is a toothbrush holder that provides a sanitary method of stabilizing a toothbrush for application of toothpaste. The design comprises a horizontal stabilizer for the brush end of the toothbrush, with a recessed space for the brush end. The stabilizer includes an underside with a flat surface that will rest against the sink counter and provide stability in use. The toothbrush holder can be easily rinsed off or placed in a dishwasher for sanitation. A vertical stand feature is added for storage and to allow the toothbrush to air dry. Finally, the horizontal toothbrush stabilizer design allows the incorporation of art that is applied via embossing or by shaping.

1 Claim, 7 Drawing Sheets

(56) References Cited

U.S. PATENT DOCUMENTS

| | | | | |
|---|---|---|---|---|
| 2004/0060829 | A1* | 4/2004 | Oldenkamp | A47K 5/04 206/77.1 |
| 2008/0245681 | A1* | 10/2008 | Healis | A47K 1/09 206/209.1 |
| 2009/0242442 | A1* | 10/2009 | Kaddissi | A47K 1/09 206/362.3 |
| 2009/0262606 | A1* | 10/2009 | Trost | A46B 15/0002 368/10 |
| 2010/0051565 | A1 | 3/2010 | Fonseca | |
| 2015/0047671 | A1* | 2/2015 | Kordecki | A47K 1/09 132/325 |
| 2016/0120373 | A1* | 5/2016 | Strong | B65D 51/249 211/65 |
| 2016/0296078 | A1* | 10/2016 | Beckerman | A46B 5/002 |

* cited by examiner

HORIZONTAL AND VERTICAL TOOTHBRUSH HOLDER SUITABLE FOR THE APPLICATION OF TOOTHPASTE

CROSS REFERENCE TO RELATED APPLICATIONS

This application claims the benefit of provisional application No. 62/276,054, filed on Jan. 7, 2016. The prior provisional application is incorporated by reference herein.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

This invention is directed toward oral hygiene, and in particular, the articles and methods of how a toothbrush is utilized.

(2) Description of Related Art

Others have worked in the field of toothbrush holders. In general, the designs are targeted around holding a toothbrush for convenient storage, allowing it to air dry, and separating individual toothbrushes for improved sanitation. Common additional conveniences for a toothbrush holder include adding a space for a drinking cup and storing a tube of toothpaste.

For example, U.S. Pat. No. D171,001 shows a toothbrush holder with slots for vertically oriented toothbrushes around the perimeter of a holder for a drinking cup. This kind of design, and similar vertical toothbrush holding designs, has good use for toothbrush storage, but does not address certain issues with how toothbrushes are used in some cases.

When a child uses a toothbrush, the application of the toothpaste onto the toothbrush presents certain challenges. Children have less fine motor control and it can be difficult to apply the toothpaste in one hand and hold the toothbrush in the other. A child will frequently attempt to utilize both hands in squeezing and holding the toothpaste, and set the toothbrush on the sink perimeter or sink counter. When attempting to apply the toothpaste, the toothbrush will move. If the child sets the toothbrush on the perimeter of the sink, the toothbrush has a likelihood of falling into the sink or on the floor. When this happens, the toothbrush is exposed to bacteria, and the sanitary handling of the toothbrush is compromised. There is a need to re-clean and sanitize the toothbrush before use.

Similarly, some adults are permanently or temporarily incapacitated and only have a single hand available for brushing their teeth. There is no practical way to manually squeeze a toothpaste tube and hold the toothbrush in a way that the toothpaste can be applied. Intuitive methods of applying toothpaste in this situation involve setting the toothbrush on the sink counter and squeezing the toothpaste onto the toothbrush. Again, this method does not provide for sanitary handling of the toothbrush.

These problems can be somewhat addressed by providing an automated toothpaste dispenser that only requires the use of one hand. For example, a dispenser as seen in U.S. Pat. No. 6,364,165, can be utilized to provide a predetermined amount of toothpaste when a sensor determines that a toothbrush is in place to receive the toothpaste. Such solutions are overly complicated, relatively expensive, and require electric power from a wall outlet or battery. Additionally, such solutions do not address the need to provide a convenient method to clean the dispenser. Convenience is important when traveling to hotels for business travel, personal travel, or children sleep overs. A toothbrush holder that is easy to pack and take along is a better solution when compared to using a toothpaste dispenser.

Other toothbrush holders include US 20100051565 which discloses a method of holding one or more toothbrushes horizontally. However, the overall stability of this design is questionable considering the height at which the toothbrushes are held, it is over large for the purpose, and is less appealing to clean due to its size.

Another consideration is encouraging children in oral hygiene. It is desirable that a toothbrush holder includes artwork designs that encourage sanitary use of a toothbrush. Also, it is desirable to utilize separate holders between children in the same family.

Importantly, children with special needs such as Down Syndrome, Autism or without an upper limb have more challenges and delays in motor skills that make holding a toothbrush steady to apply toothpaste very difficult. Adults, Senior Citizens that have onset disabilities or disease such as Parkinson's, Arthritis, Stroke or Amputation have struggles that are getting worse and therefore need a solution for holding their toothbrush stable for application of toothpaste.

There is a need in the art for a simplified method of stabilizing a toothbrush for the application of toothpaste by a child or an adult that only utilizes a single hand. Preferably, the solution is easy and intuitive to use, provides for a stabilized toothbrush in the horizontal orientation, and provides for a way to clean and sanitize any toothbrush stabilizing device.

BRIEF SUMMARY OF THE INVENTION

The embodied invention is a horizontal toothbrush holder that provides a sanitary method of stabilizing a toothbrush for application of toothpaste. The design comprises a holder for the brush end of the toothbrush, with a recessed space for the brush end. The stabilizer includes an underside with a flat surface that will rest against the sink counter and provide stability in use. The toothbrush holder can be easily rinsed off or placed in a dishwasher for sanitation. A vertical holding feature is added for storage and to allow the toothbrush to air dry. Finally, the toothbrush holder design allows the incorporation of art that is applied via embossing or by shaping.

BRIEF DESCRIPTION OF THE SEVERAL VIEWS OF THE DRAWING(S)

DETAILED DESCRIPTION OF THE INVENTION

Figure 1A:
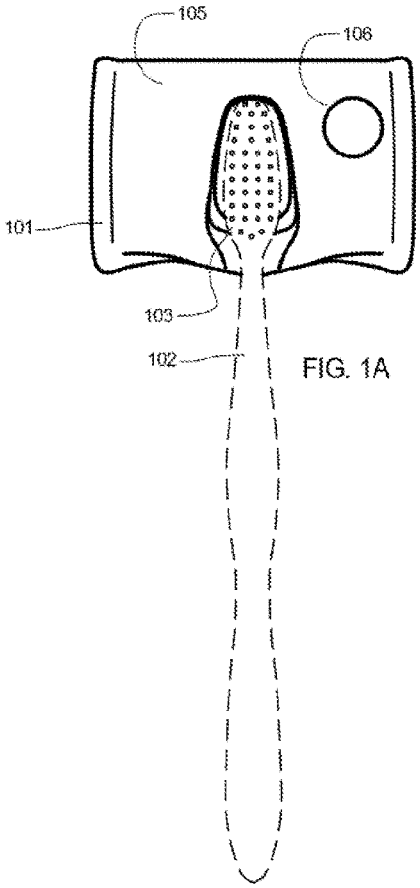
FIGS. 1A-1C are an illustration of one embodied design of the toothbrush holder with a vertical stand.
Figure 1B:
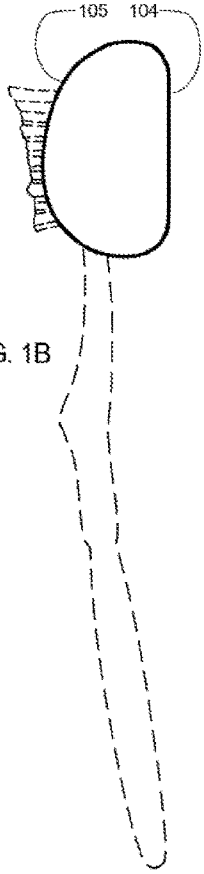
Figure 1C:
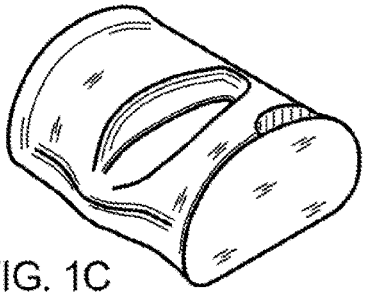

In one embodiment of the invention as illustrated in FIGS. 1A-1B, a toothbrush 102 with a brush 103 one the end is resting inside a toothbrush holder 101. In FIG. 1B a right end view of the toothbrush holder is shown. A flat surface 104 on the underside of the toothbrush holder is shown as well as an upper surface 105. FIG. 1C shows a perspective view of the toothbrush holder without the toothbrush. For stability, the surface area of the flat surface 104 is 30 to 100% of the upper side area as projected onto a plan view as would be seen in the plan view of FIG. 1A. A cylindrically shaped hole 106 is used for holding the toothbrush for vertical toothbrush storage and to allow the toothbrush to air dry.

Figure 2:
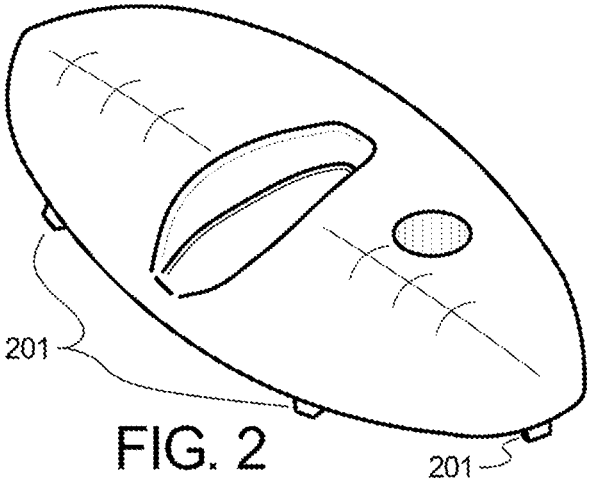
FIG. 2 is another embodied design.

FIG. 2 is another embodied design in the shape of a football shaped to receive one toothbrush size. Elevating tabs 201 are attached to the underside of the football toothbrush holder. In this case, the underside of the toothbrush holder becomes a lower mounting surface for the elevating tabs. The elevating tabs are preferably molded into the toothbrush holder shape, but this is not a strict requirement.

Figure 3:
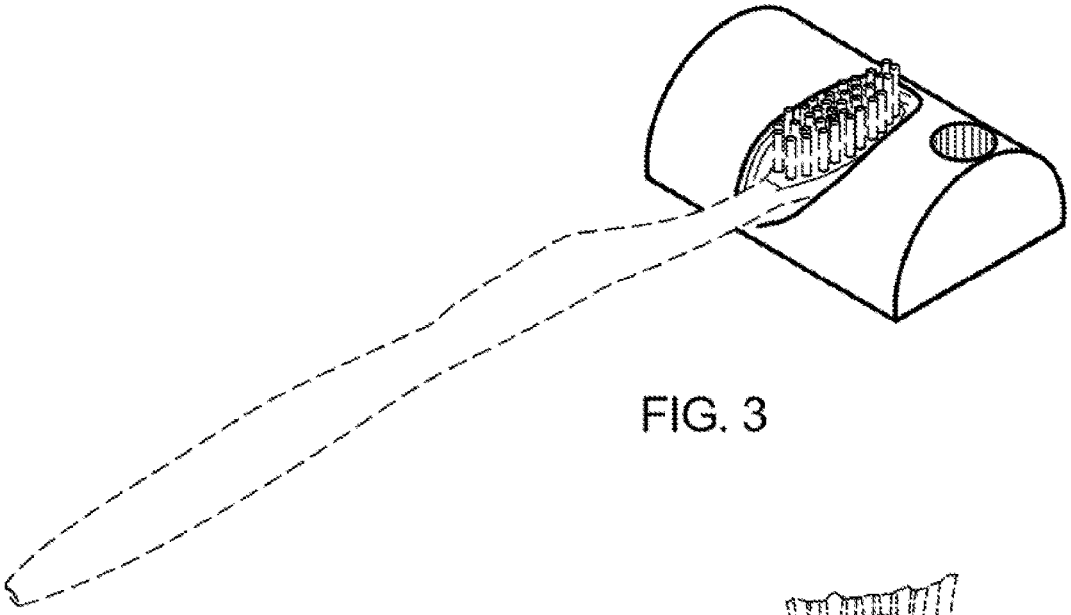
FIG. 3 is another embodied design.
Figure 4:
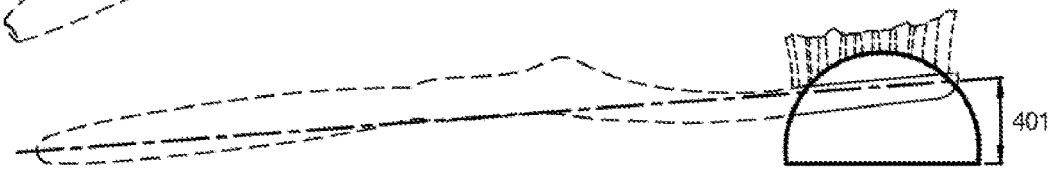
FIG. 4 is a right-side view of FIG. 3.

FIGS. 3 and 4 show an embodiment of the invention. In this case, the art is simplified into a rounded block, and the brush is set into a recessed area of the toothbrush holder. The angle of the brush 401 relative to the horizontal plane is preferably less than 30 degrees, and a preferred embodiment is a range of 15-20%. The angle of the brush is low enough for stability, and allows even distribution of the toothpaste onto the brush end.

Figure 5:
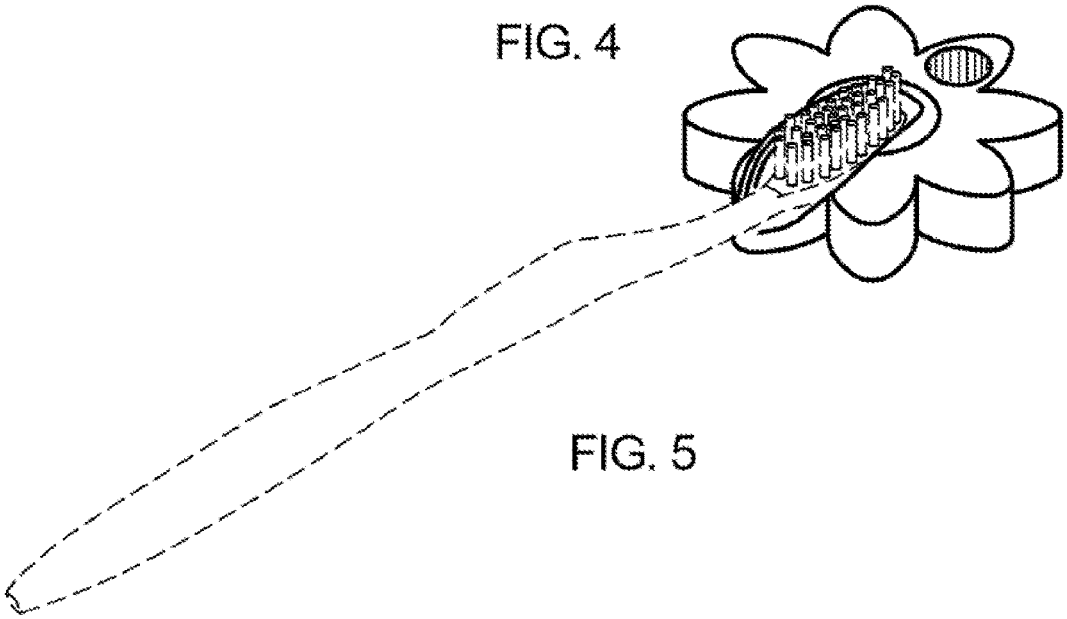
FIG. 5 is another embodied design with artwork in the shape of a flower with pedals.

FIG. 5 shows alternate embodied artwork with flower pedals.

Figure 6:
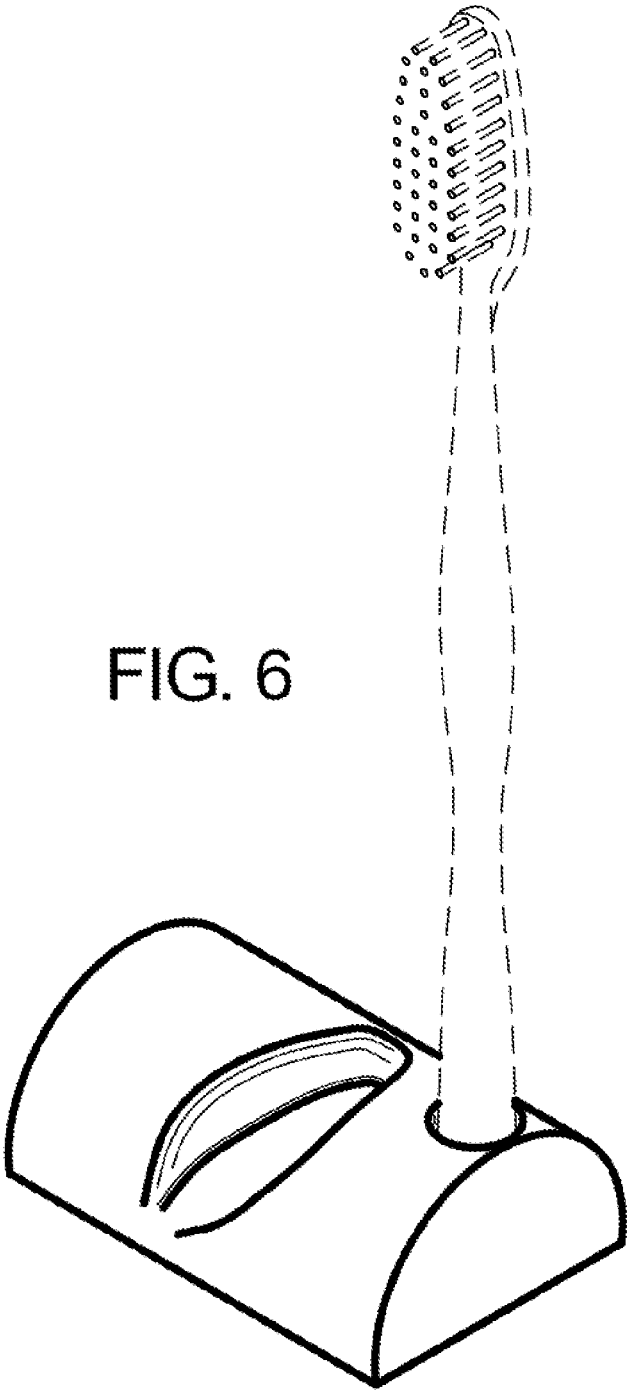
FIG. 6 shows how the toothbrush is stored vertically when not being used.

FIG. 6 shows how the toothbrush is stored vertically when not being used.

The embodied invention preferably includes artwork that would increase the likelihood of use, especially among young children. Artwork types that can be utilized includes, but not is limited to, items from sports, royalty titles, movies, transportation, education, animals, TV, books, items useful for play, comics, company names and logos, individualized artwork, individualized text and graphics, etc. Artwork can be printed, embossed, stamped, or pressed onto the surface of a rectangular, oval or round shape. The shape of the toothbrush stabilizer can also be modified so that it has a 3D appearance.

In one embodiment of the invention, a bottom surface of the toothbrush holder incorporates a flat surface so that the toothbrush holder is stable on a sink counter top. In another embodiment, a bottom mounting surface is connected to elevating tabs. In this case, the bottom mounting surface is not required to be flat. The toothbrush holder includes a recessed area for the brush end of the toothbrush.

The toothbrush holder is designed to withstand a dishwasher cleaning (or other sterilizing method) by the proper choice of material. Suitable materials include plastic polymers, which do not lose shape or deform when a hot water with dishwasher soap is applied to the toothbrush holder in a normal washing or sanitizing cycle (130-170° F.). Suitable plastics include, but are not limited to, polyethylene, polypropylene, polystyrene, PVC, and PET.

Figure 7:
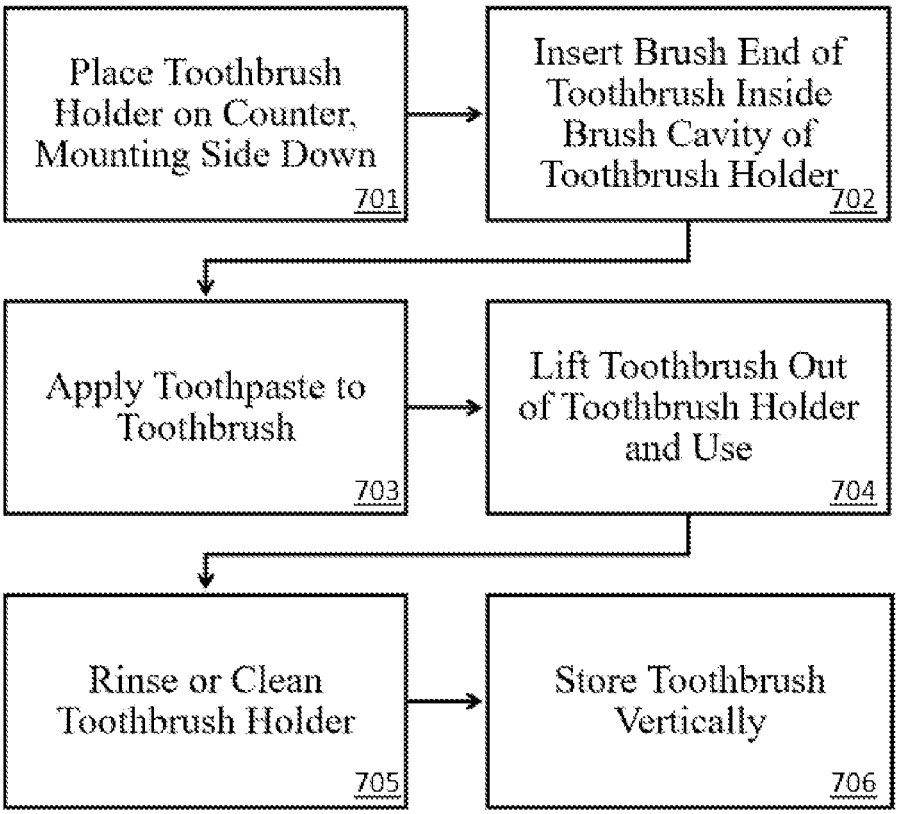
FIG. 7 are method steps which utilize said toothbrush holder in the application of toothpaste.

The conceived invention incorporates the following features:

1. A three dimensional toothbrush holder made from a solid material, such as a plastic
2. The toothbrush holder shaped or embossed in an attractive manner such as a geometric shape or artwork.
3. A recessed cavity to hold the brush end of the toothbrush, and preferably incorporates more than one brush size.
4. A mounting surface on the bottom of the toothbrush holder.
5. elevating tabs to raise the toothbrush holder above a sink counter (or other) surface.
6. A vertical toothbrush holder with a drain hole As seen in FIG. 7, the conceived invention additionally includes how it is used and incorporates the following steps:

1. Place Toothbrush Holder on Counter, Mounting Side Down 701
2. Insert Brush End of Toothbrush Inside Brush Cavity of Toothbrush Holder 702
3. Apply Toothpaste to Brush End of Toothbrush 703
4. Lift Toothbrush Out of Toothbrush Holder and Use 704
5. After Brushing Teeth; Rinse, or Clean Toothbrush Holder 705
6. Store Toothbrush Vertically 706

Figure 8:
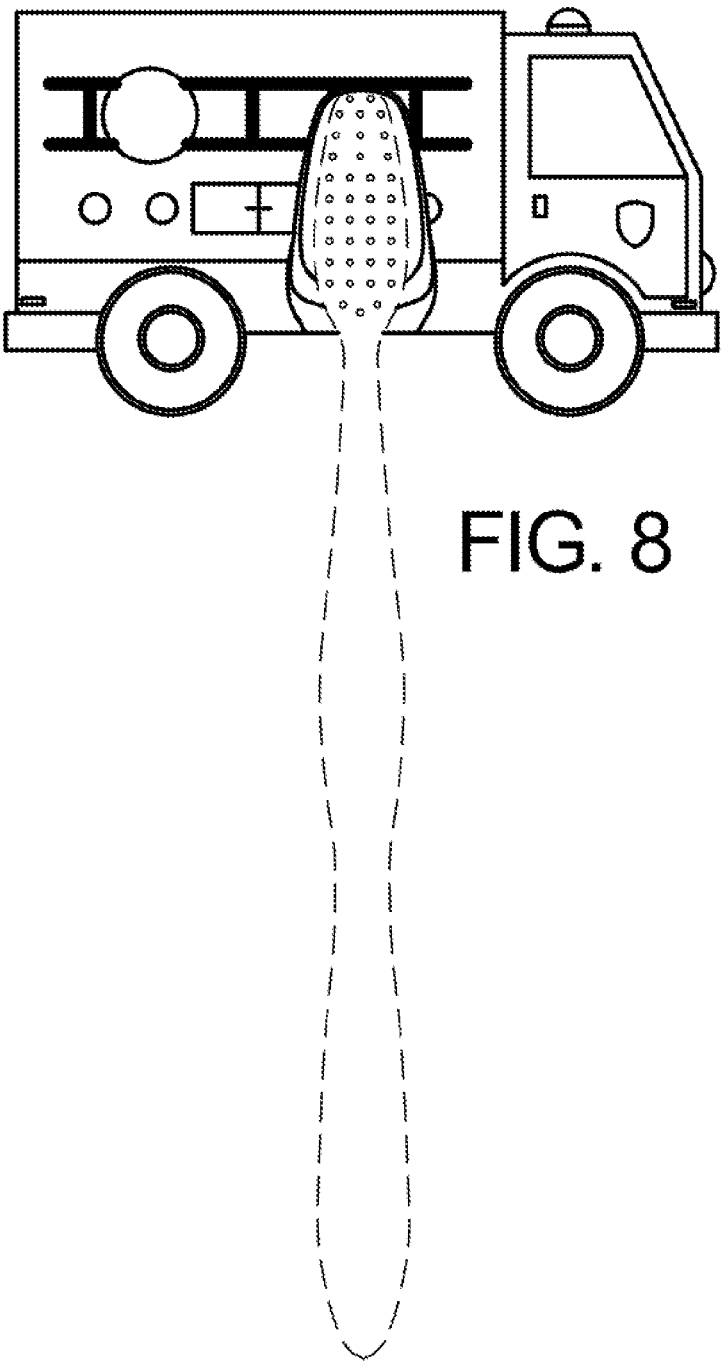
FIG. 8 is another embodied design with artwork in the shape of a firetruck.

FIG. 8 shows alternate embodied artwork with flower pedals.

Figures 9A, 9B:
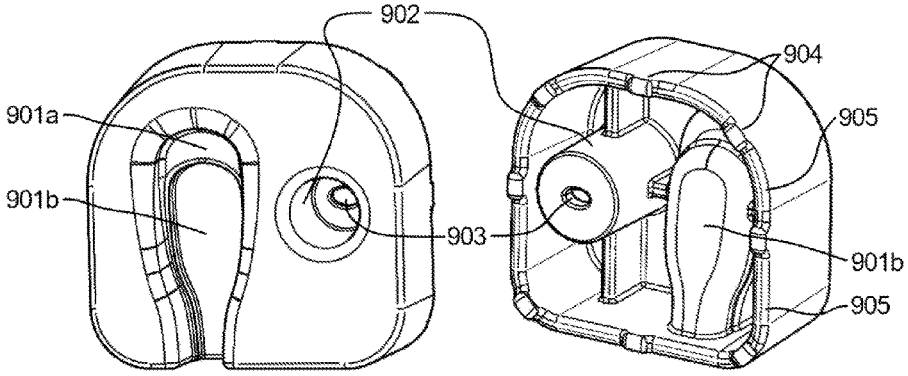
FIGS. 9A-9B is another embodied design.

FIGS. 9A and 9B show a preferred embodied design with compact art and economical production. In this embodiment, common toothbrush holder features for many types of artwork shown. An upper toothbrush position 901*a* and a lower toothbrush position 901*b* are incorporated into the design. A vertical toothbrush holder 902 (cylindrical holder) and a drain hole 903 are also incorporated into the design. The drain hole prevents any water that drips down the toothbrush from accumulating in the cylindrical holder. Any of this water then drains to the sink top. To prevent sink top water from building up underneath the toothbrush holder, small elevating tabs 904 (in this figure eight are shown) provide the 1/16" elevation needed on the lower mounting surface 905. Elevations of 1/16" to 1/4" are desirable to allow the sink top to dry underneath the toothbrush holder.

FIGS. 9A and 9B show a shaped toothbrush holder that is efficient and lightweight. The holder is economically produced by minimizing the needed material through forming the desired shape in a substantially uniform thickness, or multiple thicknesses. Forming processes include injection molding, heated pressing, and vacuum molding.

FIGS. 9A and 9B also illustrate two important features that are preferably incorporated in any toothbrush holder. One is the drip hole in the bottom of the cylindrical vertical toothbrush holder, and the other is multiple elevating tabs on the bottom surface of the toothbrush holder. Both are important to allow the toothbrush to completely dry, and allow the sink top to dry.

The conceived invention is a simple method for children who use two hands for applying the toothpaste. Also, an adult who only has one hand available for the application of toothpaste will find the toothbrush holder useful.

The conceived invention has advantages in being compact and washable.

While various embodiments of the embodied invention have been described, the invention may be modified and adapted to various operational methods to those skilled in the art. Therefore, this invention is not limited to the description and figure shown herein, and includes all such embodiments, changes, and modifications that are encompassed by the scope of the claims.

We claim:

1. A sanitary method of applying toothpaste onto a toothbrush by use of a toothbrush holder comprising:

A) providing 1) a three dimensional object, 2) wherein said three dimensional object has an upper surface and a lower mounting surface, 3) a horizontal toothbrush holding cavity located in said upper surface, 4) wherein said horizontal toothbrush holding cavity is shaped to hold at least one size of a brush end of a toothbrush, 5) a vertical toothbrush holding cavity that is substantially cylindrical in shape, wherein said vertical toothbrush holding cavity is sized to hold a single toothbrush, 6) wherein said vertical toothbrush holding cavity incorporates a drain hole, and 7) a plurality of elevating tabs incorporated on said lower mounting surface, and B) placing said brush end of said toothbrush into said horizontal toothbrush holding cavity, C) applying toothpaste onto said brush end of said toothbrush, D) lifting said toothbrush out of said toothbrush holder for use, and E) rinsing or sanitary cleaning said toothbrush holder for next use.

* * * * *